US011316280B2

(12) United States Patent
West et al.

(10) Patent No.: US 11,316,280 B2
(45) Date of Patent: Apr. 26, 2022

(54) TILING SYSTEM AND METHOD FOR AN ARRAY ANTENNA

(71) Applicant: Rockwell Collins, Inc., Cedar Rapids, IA (US)

(72) Inventors: James B. West, Cedar Rapids, IA (US); Matilda G. Livadaru, Marion, IA (US); Christopher G. Olson, Robins, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 162 days.

(21) Appl. No.: 16/008,983

(22) Filed: Jun. 14, 2018

(65) Prior Publication Data

US 2019/0013592 A1 Jan. 10, 2019

Related U.S. Application Data

(63) Continuation of application No. 14/832,908, filed on Aug. 21, 2015, now Pat. No. 10,038,252.

(51) Int. Cl.

| | |
|---|---|
| ***H01Q 21/00*** | (2006.01) |
| ***H01Q 21/06*** | (2006.01) |
| ***H01Q 3/46*** | (2006.01) |

(52) U.S. Cl.

CPC ..... *H01Q 21/065* (2013.01); *H01Q 3/46* (2013.01); *H01Q 21/0087* (2013.01)

(58) Field of Classification Search

CPC .. H01Q 21/0087; H01Q 21/065; H01Q 21/06; H01Q 21/00; H01Q 3/46

See application file for complete search history.

(56) References Cited

U.S. PATENT DOCUMENTS 6,114,997 A * 9/2000 Lee ..... H01Q 1/38 343/700 MS
6,297,775 B1 * 10/2001 Haws ..... H01Q 1/02 343/700 MS (Continued)

FOREIGN PATENT DOCUMENTS

| | | |
|---|---|---|
| CN | 101359777 | 2/2009 |
| CN | 102646860 | 8/2012 |

(Continued)

OTHER PUBLICATIONS

First Office Action for CN Patent Application No. 201610659084.9 dated Dec. 3, 2019. 28 pages.

(Continued)

*Primary Examiner* — Tho G Phan
(74) *Attorney, Agent, or Firm* — Suiter Swantz pc llo

(57) ABSTRACT

The system can include and the method can provide a first printed circuit board antenna tile. The first printed circuit board antenna tile comprises a repeating pattern of antenna element units. The antenna can also include and the method can also provide a second first printed circuit board antenna tile comprising the repeating pattern. The first printed circuit board antenna tile and the second first printed circuit board antenna tile can be attached such that the antenna elements maintain the same spacing in an X-Y plane associated with the repeating pattern across a boundary the first printed circuit board antenna tile and the second first printed circuit board antenna tile.

7 Claims, 8 Drawing Sheets

(56) References Cited

U.S. PATENT DOCUMENTS

| | | | | |
|---|---|---|---|---|
| 6,624,787 | B2 * | 9/2003 | Puzella | H01Q 9/0407 343/700 MS |
| 6,650,291 | B1 | 11/2003 | West et al. | |
| 6,995,726 | B1 | 2/2006 | West et al. | |
| 7,034,753 | B1 | 4/2006 | Elsallal et al. | |
| 7,336,240 | B2 * | 2/2008 | Yuki | H01Q 21/0025 343/853 |
| 7,411,472 | B1 | 8/2008 | West et al. | |
| 7,436,361 | B1 | 10/2008 | Paulsen et al. | |
| 7,511,664 | B1 * | 3/2009 | Mason | H01Q 1/02 342/372 |
| 7,688,269 | B1 | 3/2010 | West | |
| 7,839,349 | B1 | 11/2010 | West | |
| 7,965,249 | B1 | 6/2011 | Wolf et al. | |
| 8,081,118 | B2 * | 12/2011 | McCarthy | H01Q 9/0414 343/700 MS |
| 8,098,189 | B1 | 1/2012 | Woodell et al. | |
| 8,217,850 | B1 | 7/2012 | Jennings et al. | |
| 8,390,529 | B1 | 3/2013 | Paulsen et al. | |
| 8,466,846 | B1 | 6/2013 | Elsallal et al. | |
| 8,736,504 | B1 | 5/2014 | West et al. | |
| 8,743,015 | B1 | 6/2014 | West et al. | |
| 8,878,728 | B1 | 11/2014 | Livadaru et al. | |
| 8,902,114 | B1 | 12/2014 | West et al. | |
| 9,024,805 | B1 | 5/2015 | Jinkins et al. | |
| 9,024,834 | B1 | 5/2015 | Elsallal et al. | |
| 9,116,244 | B1 | 8/2015 | West et al. | |
| 9,653,820 | B1 | 5/2017 | West et al. | |
| 9,761,939 | B2 * | 9/2017 | Pietila | H01Q 21/0025 |
| 10,170,829 | B2 * | 1/2019 | Le Roy-Naneix | H01Q 9/0421 |
| 2012/0249374 | A1 | 10/2012 | Wang | |
| 2012/0268344 | A1 | 10/2012 | McCarthy | |
| 2017/0179763 | A9 | 6/2017 | Leabman et al. | |

FOREIGN PATENT DOCUMENTS

| | | | |
|---|---|---|---|
| CN | 102646860 | A | 8/2012 |
| WO | WO-2014/197328 | | 12/2014 |

OTHER PUBLICATIONS

U.S. Appl. No. 13/714,209, filed Dec. 13, 2012, Wyse et al.
U.S. Appl. No. 13/737,777, filed Jan. 9, 2013, Wyse et al.
U.S. Appl. No. 13/760,964, filed Feb. 6, 2013, Finley et al.
U.S. Appl. No. 13/781,449, filed Feb. 28, 2013, West et al.
U.S. Appl. No. 13/837,934, filed Mar. 15, 2013, West et al.
U.S. Appl. No. 14/300,021, filed Jun. 9, 2014, West et al.
U.S. Appl. No. 14/300,055, filed Jun. 9, 2014, West et al.
U.S. Appl. No. 14/300,074, filed Jun. 9, 2014, West et al.
Non-Final Office Action for U.S. Appl. No. 14/832,908 dated Nov. 6, 2017.
Notice of Allowance for U.S. Appl. No. 14/832,908 dated Mar. 26, 2018. 7 pages.
Notice of Allowance in Chinese Application #201610659084A dated Apr. 22, 2021, 1 pages (No Translation).
Office Action in Chinese Application #201610659084A dated Aug. 12, 2020, 4 pages (No Translation).
Office Action in Chinese Application #201610659084A dated Jan. 25, 2021, 4 pages (No Translation).

* cited by examiner

TILING SYSTEM AND METHOD FOR AN ARRAY ANTENNA

CROSS-REFERENCE TO RELATED APPLICATIONS

This application claims the benefit of and priority to and is a Continuation of U.S. application Ser. No. 14/832,908, filed on Aug. 21, 2015, by West et al., which is related to U.S. application Ser. No. 14/300,021, filed on Jun. 6, 2014, by West et al., U.S. application Ser. No. 14/300,074, filed on Jun. 6, 2014, by West et al., and U.S. application Ser. No. 14/300,055, filed on Jun. 6, 2014, by West et el., all assigned to the Assignee of the present application and hereby incorporated by reference in their entireties.

BACKGROUND

The present disclosure relates generally to the field of antenna systems. More specifically, the present disclosure relates generally to the field of antenna arrays including but not limited to, phased array antenna systems or electronically scanned array (ESA) antenna systems, such as active electronically scanned array (AESA) antenna systems.

Antenna arrays, such as, printed circuit board (PCB) and printed wiring board (PWB) based apertures (e.g., low profile PCB based AESA radiation apertures), have a limited size due to printed circuit board material fabrication tools, printed circuit board etching/lamination processes, and assembly processes and equipment for attaching electronic components to the printed circuit board. PCBs, as well as PWBs, used in low-profile antennas can become warped due to the required constructions and construction techniques. Minimizing absolute multi-layer printed circuit board warping and maximizing printed circuit board manufacturing yield requires the use of apertures sized within the range appropriate to the capitalization and processes of both the PWB manufacturer and the Printed Circuit Assembly (PCA) facility. Further, random and deterministic excitation errors across the aperture of conventional antennas increase with panel size (e.g., circuit board size). It is desirable to provide larger aperture antennas.

Thus, there is a need for a printed circuit board antenna system with a larger aperture. Further, there is a need for a robust, large aperture AESA-based or other array-based system with low absolute warping. Yet further, there is a need for high yield, high reliability process for manufacturing a large printed circuit board antenna array. Even further, there is a need for a low cost manufacturing process for large antenna arrays.

SUMMARY

In one aspect, the inventive concepts disclosed herein are directed to a system and method. The system can include a first printed circuit board antenna tile. The first printed circuit board antenna tile comprises a repeating pattern of antenna element units, wherein each of the antenna element units comprises at least three antenna elements. The system can also include a second first printed circuit board antenna tile comprising the repeating pattern. The first printed circuit board antenna tile and the second first printed circuit board antenna tile can be attached such that the repeating pattern across a boundary of the first printed circuit board antenna tile and the second first printed circuit board antenna tile is maintained.

In another aspect, the inventive concepts disclosed herein are directed to a system and method. The system can include a first printed circuit board antenna tile. The first printed circuit board antenna tile comprises a repeating pattern of antenna element units, wherein each of the antenna element units comprises at least three antenna elements. One antenna element in a first set of the antenna element units is disposed in a first row, and two antenna elements in the first set of the antenna element units are disposed in a second row. One antenna element in a second set of the antenna element units is disposed in the second row, and two antenna elements in the second set of the antenna element units are disposed in the first row. The system can also include a second first printed circuit board antenna tile comprising the repeating pattern. The first printed circuit board antenna tile and the second first printed circuit board antenna tile can be attached such that the repeating pattern across a boundary of the first printed circuit board antenna tile and the second first printed circuit board antenna tile is maintained.

In a further aspect, the inventive concepts disclosed herein are directed to a method making a printed circuit board antenna array. The method includes providing a first printed circuit board antenna tile. The first printed circuit board antenna tile comprises a repeating pattern of antenna element units, wherein each of the antenna element units comprises at least three antenna elements. One antenna element in a first set of the antenna element units is disposed in a first row, and two antenna elements in the first set of the antenna element units is disposed in a second row. One antenna element in a second set of the antenna element units is disposed in the second row, and two antenna elements in the second set of the antenna element units is disposed in the first row. The method includes providing a second first printed circuit board antenna tile comprising the repeating pattern and attaching the first printed circuit board antenna tile and the second first printed circuit board antenna tile such that the antenna elements maintain the same spacing in an X-Y plane associated with the repeating pattern across a boundary of the first printed circuit board antenna tile and the second first printed circuit board antenna tile.

In yet further aspect the inventive concepts disclosed herein are directed to an antenna. The antenna includes antenna tiles. The antenna tiles include a repeating pattern of antenna element units. Each of the antenna element units comprise at least three antenna elements; one antenna element in a first set of the antenna element units is disposed in a first row, and two antenna elements in the first set of the antenna element units are disposed in a second row. One antenna element in a second set of the antenna element units is disposed in the second row and two antenna elements in the second set of the antenna element units are disposed in the first row. The antenna tiles are joined to each other at a serpentine edge; the serpentine edge is configured so that the antenna elements in each antenna element unit are not divided at the serpentine edge.

In a further aspect, the inventive concepts disclosed herein are directed to an antenna. The antenna includes antenna tiles include a first antenna tile and a second antenna tile, and the antenna tiles include a repeating pattern of antenna element units. Each of the antenna element units include at least three antenna elements; one antenna element in a first set of the antenna element units is disposed in a first row, and two antenna elements in the first set of the antenna element units are disposed in a second row. One antenna element in a second set of the antenna element units is disposed in the second row, and two antenna elements in the second set of the antenna element units are disposed in the first row. The antenna tiles are joined to each other at an overlapping interface. The first antenna tile partially overlaps the second antenna tile at the overlapping interface. The overlapping interface has a width; a portion of first antenna tile has a radio frequency transparent portion disposed at a location of at least a portion of an antenna element at least partially within the width and on the second antenna tile.

In a further aspect, the inventive concepts disclosed herein are directed to a method of making an antenna array. The method includes providing a first printed circuit board antenna tile. The first printed circuit board antenna tile includes a pattern of first antenna element units and a first partial antenna element unit. The first antenna element units include first conductors and second conductors and the first conductors and the second conductors are disposed in a first direction and separated by a first gap. The first partial antenna element unit comprises third conductors disposed in the first direction. The method also includes providing a second printed circuit board antenna tile. The second printed circuit board antenna tile includes a pattern of second antenna element units and a second partial antenna element unit, and the second partial antenna element unit includes fourth conductors disposed in the first direction. The method also includes attaching the first printed circuit board antenna tile and the second printed circuit board antenna tile such that the second partial antenna element unit and the first partial antenna element unit form a first complete antenna element unit. A first border between the first printed circuit board antenna tile and the second printed circuit board antenna tile is disposed between the third conductors and the fourth conductors.

BRIEF DESCRIPTION OF THE DRAWINGS

Embodiments of the inventive concepts disclosed herein will become more fully understood from the following detailed description, taken in conjunction with the accompanying drawings, wherein like reference numerals refer to like elements, in which.

DETAILED DESCRIPTION

Figure 1A:
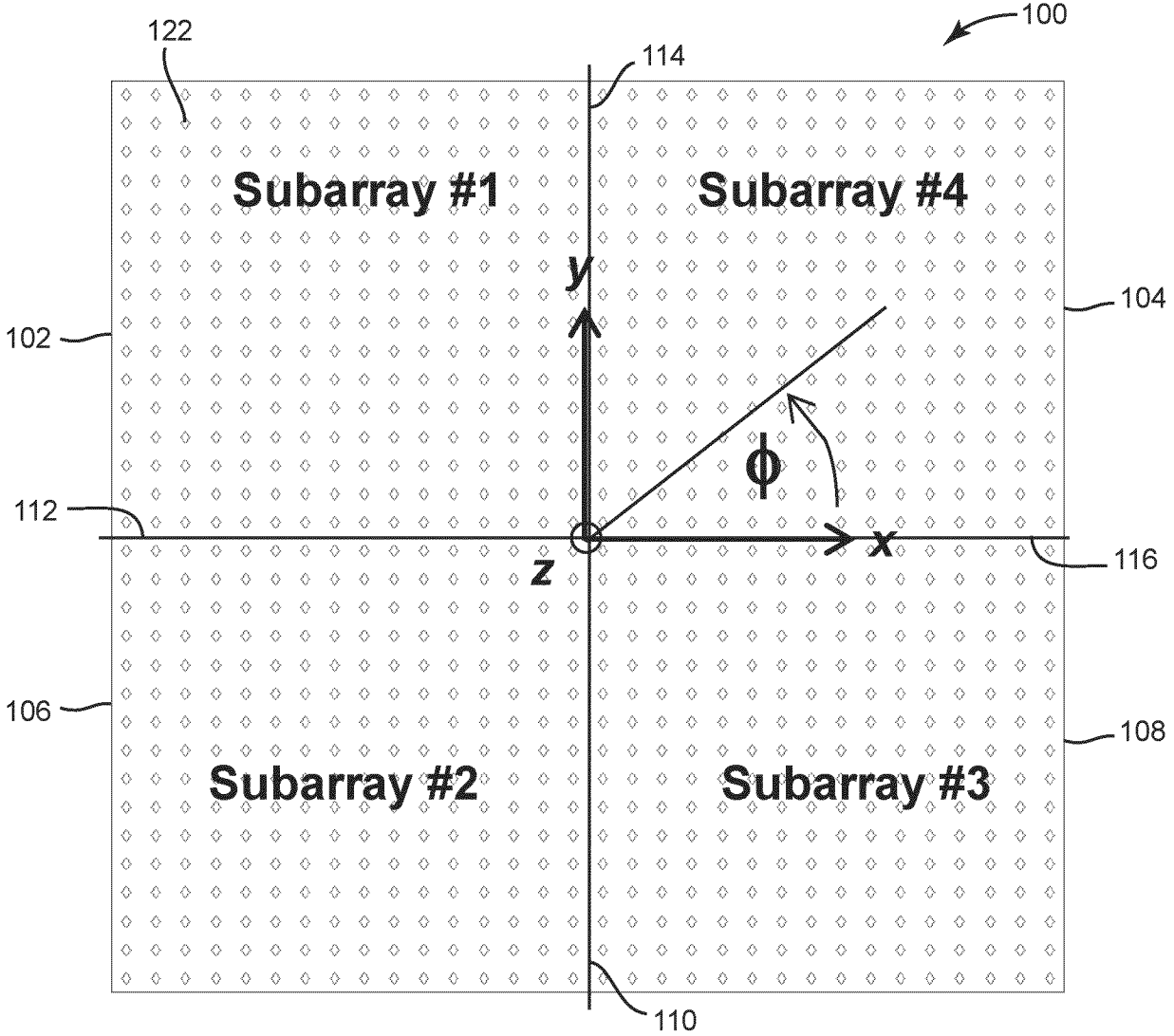
FIG. 1A is a top view simplified schematic representation of an antenna system including four sub-panels in accordance with some embodiments of the inventive concepts disclosed herein.

Before describing in detail the particular improved system and method, it should be observed that the inventive concepts disclosed herein include, but are not limited to a novel structural combination of components and circuits, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art having the benefit of the description herein. Further, the inventive concepts disclosed herein are not limited to the particular embodiments depicted in the exemplary diagrams, but should be construed in accordance with the language in the claims.

Referring generally to the figures, an antenna system is shown and described that may be used in radar, sensor and communications systems. The antenna system can be a planar surface or curved surface antenna array. In some embodiments, the systems and methods described can be utilized in communication, sensing and/or radar systems, such as, military radar systems or weather radar systems, electronic intelligence (ELINT) receivers, electronic counter measure (ECM) systems, electronic support measure (ESM) systems, targeting systems or other systems. In some embodiments, the systems and methods are utilized to provide an ultra-wide band (UWB) system. The antenna arrays can include but are not limited to phased-array antenna systems, electronically scanned array antenna systems, or electronically scanned array (ESA) antenna systems, such as active electronically-scanned array (AESA) antenna systems.

In some embodiments, printed circuit board-based (PCB-based) or printed wire board based (PWB-based) low profile radiation apertures, such as, electronically scanned array radiation apertures, use an advanced printed aperture (APA) antenna system having a size that is not limited by PCB fabrication tools, PCB etching/lamination processes, and assembly processes for electronic component attachment. The antenna system is comprised of a multitude of antenna elements provided in a pattern or array on a number of circuit board subpanels in some embodiments. In some embodiments, the APA antenna system includes sub-panels or individual circuit boards that are joined together to form a larger radiation aperture. In some embodiments, the circuit boards are joined by overlapping borders or serpentine borders (e.g., sinusoidal borders, zigzag borders, saw tooth border, etc.) to preserve antenna element patterns. In some embodiments, the antenna element is configured so that the border can exist between conductors of an antenna element and the antenna element is partially provided on two or more circuit boards or sub-panels.

With reference to FIG. 1A, an antenna system 100A-C includes sub panels, such as, a circuit board 102, a circuit board 104, a circuit board 106, and a circuit board 108. The circuit boards 106 and 108 are separated by a border 110. The circuit boards 102 and 104 are separated by a border 114. The circuit boards 104 and 108 are separated by a border 116, and the circuit boards 102 and 106 are separated by a border 112. The circuit boards 102, 104, 106, and 108 are separately manufactured according to printed circuit board techniques and joined at the borders 110, 112, 114 and 116. Electronic components are attached to the circuit boards 102, 104, 106 and 108 before the circuit board 102, 104, 106 and 108 are joined in some embodiments.

The circuit boards 102, 104, 106 and 108 include antenna elements 122 disposed in a pattern or array in some embodiments. Signals can be provided to and received on the antenna elements 122 and the antenna system 100A-C can be steered by appropriate shifting the phase of signals provided and received on antenna elements 122 in some embodiments. In some embodiments, the antenna system is comprised of an APA or other antenna array such as those disclosed in U.S. application Ser. No. 13/837,934, filed Mar. 15, 2013 by West et al., U.S. application Ser. No. 14/300,021, filed on Jun. 6, 2014, by West et al., U.S. application Ser. No. 14/300,074, filed on Jun. 6, 2014, by West et al., and U.S. application Ser. No. 14/300,055, filed on Jun. 6, 2014, by West et el., U.S. Pat. Nos. 9,024,834, 9,024,805, 8,902,114, 8,878,728, 8,743,015, 8,736,504, 8,466,846, 8,390,529, 8,217,850 8,098,189, 7,965,249, 7,839,349, 7,688,269, 7,436,361, 7,411,472 7,034,753, 6,995,726, and 6,650,291, all assigned to the Assignee of the present application and hereby incorporated by reference in their entireties. The APA can be comprised of sub-arrays as described herein in some embodiments. The sub-arrays can be cut from the APA and rejoined as described herein in some embodiments.

Although shown with the four circuit boards 102, 104, 106 and 108, the antenna system 100A can include a number n of circuit boards, where n is a number from 2 to N, (e.g., N being 2, 3, 4, 5, 6, 8, 10, 100, etc.). In some embodiments, the antenna system 100A is configured as a rectangular antenna system, although other shapes are possible. In addition, although the circuit boards 102, 104, 106 and 108 are shown as rectangular circuit boards, the circuit boards 102, 104, 106 and 108 can have other shapes including but not limited to curved shapes, diamond shapes, pentagonal shapes, triangular shapes, hexagonal shapes, octagonal shapes, heptagonal, pie shapes, curved shapes, etc. The circuit boards 104, 106 and 108 can be tiled or arranged together to form larger apertures of various shapes and sizes. Each of the subarrays or circuit boards 102, 104, 106, and 108 can have a different number of radiating elements, and the subarrays do not need to be identical in shape/contour. The subarray tiling can fit together like a "jigsaw puzzle" in some embodiments.

In some embodiments, the circuit boards 102, 104, 106 and 108 are offset from each other in a Z dimension (e.g., vertically with respect to the XY plane associated with the planar surface of the circuit boards 102, 104, 106 and 108). Phase or time delay processing can be utilized to compensate for any small offset in the Z dimensions. Changes in dimensions in the Z direction of the circuit boards 102, 104, 106 and 108 are manifested as deterministic or random phase errors relative to the respective nominal far field lines of sight to the target. In some embodiments, the antenna system 100A can be advantageously configured such that the antenna elements 122 are spaced in a planer array (triangular, rectangular, or radial) such that delta X, delta Y and Z dimensions are held constant across the planar aperture.

Subarray field manifolds can be integrated to each of the circuit boards 102, 104, 106 and 108. The sub array feed manifolds are attached to a back side of the circuit boards 102, 104, 106, and 108 in some embodiments. Each radiating element within the subarray is typically connected to an active Transmit/Receive Module (TRM) active radio frequency device. The TRMs in turn connect between the radiating elements and feed manifold radio frequency input/output interface. A combiner layer can be provided behind the circuit boards 102, 104, 106, and 108 to combine sub array signals from the sub array feed manifolds. A processor associated with the sub array feed manifolds or the circuit boards 102, 104, 106, and 108 can implement phase changes for Z offset compensation in some embodiments. In some embodiments, circuit boards 102, 104, 106 and 108 are abutted to retain a constant delta X, delta Y and Z axis dimension across the array.

Figure 1B:
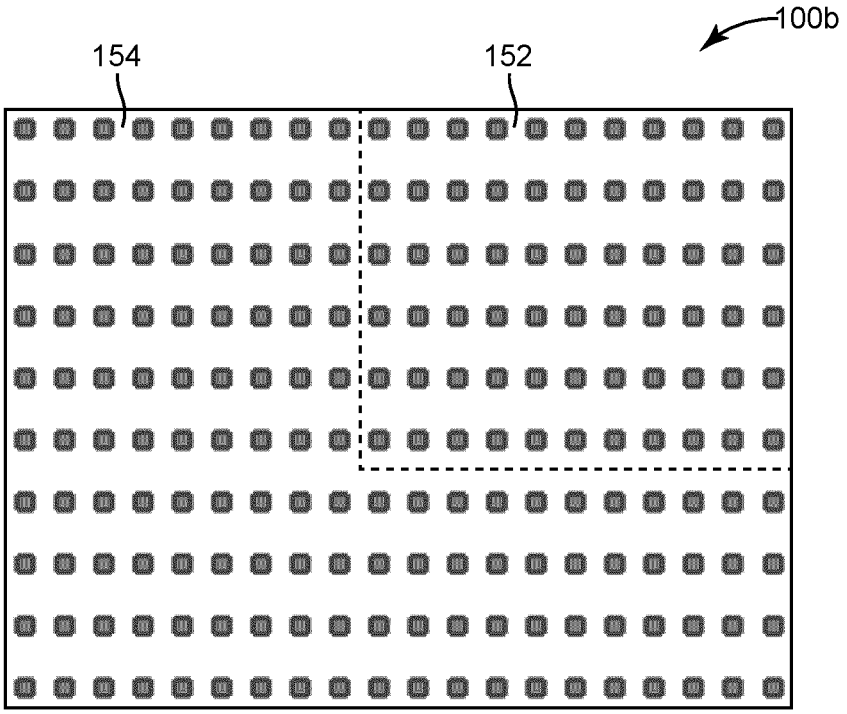
FIG. 1B is a top view simplified schematic representation of an antenna system including two sub-panels in accordance with some embodiments of the inventive concepts disclosed herein.

With reference to FIG. 1B, an antenna system 100B similar to the antenna system 100A includes sub panels, such as, a circuit board 152 and a circuit board 154. The circuit boards 152 and 154 are separated by an L-shaped border 160. The circuit boards 152 and 154 can be similar to the circuit boards 102, 104, 106, and 108. The circuit boards 152 and 154 provide a general two dimensional lattice structure (e.g., a rectangular lattice structure). Border 160 can be a serpentine border or an overlap border configured to avoid intersection with antenna elements as discussed below in some embodiments. Border 160 can be a border that intersects antenna elements as discussed below in some embodiments.

Figure 1C:
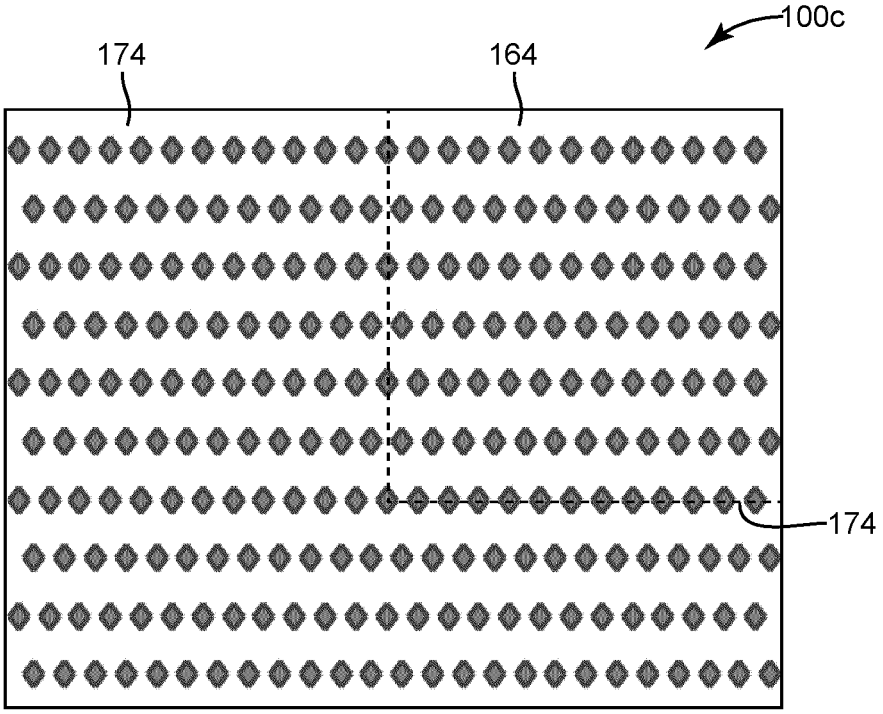
FIG. 1C is a top view simplified schematic representation of an antenna system including two sub-panels in accordance with some embodiments of the inventive concepts disclosed herein.

With reference to FIG. 1C, an antenna system 100C similar to the antenna system 100A includes sub panels, such as, a circuit board 162 and a circuit board 164. The circuit boards 162 and 164 are separated by an L-shaped border 170. The circuit boards 162 and 164 can be similar to the circuit boards 102, 104, 106, and 108. The circuit boards 162 and 164 provide a general two dimensional lattice structure (e.g., a triangular lattice structure). Border 170 can be a serpentine border or an overlap border configured to avoid intersection with antenna elements as discussed below in some embodiments. Border 160 can be a border that intersects antenna elements as discussed below in some embodiments.

Figure 2:
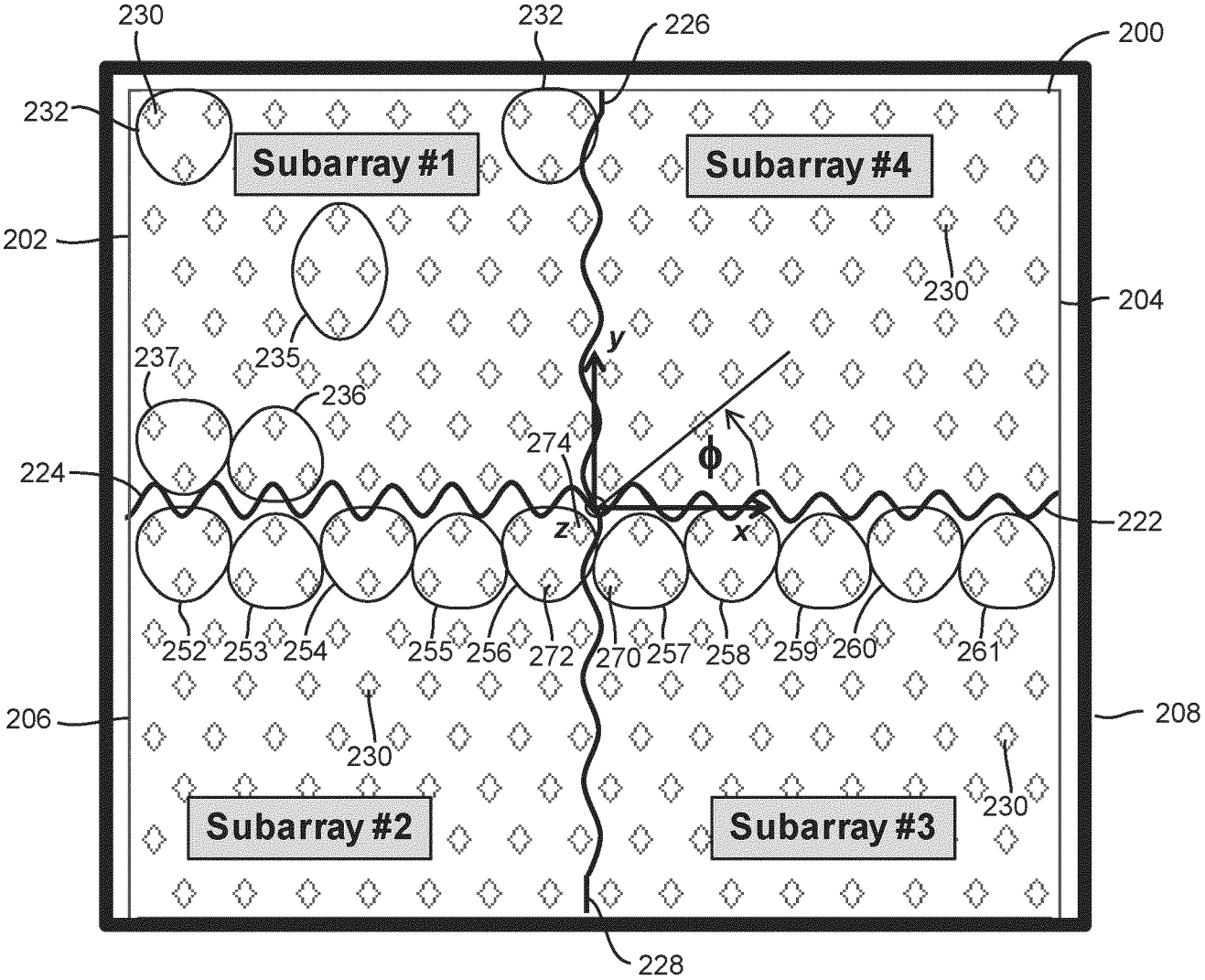
FIG. 2 is a top view more detailed simplified schematic representation of an antenna system including four sub-panels joined at a serpentine border in accordance with some embodiments of the inventive concepts disclosed herein.

With reference to FIG. 2, an antenna system 200, which is similar to the antenna system 100A-C (FIGS. 1A-C), includes a circuit board 202, a circuit board 204, a circuit board 206 and a circuit board 208. The circuit board 204 and the circuit board 208 are joined across a border 222, and the circuit board 206 and the circuit board 202 are joined across a border 224. The circuit board 202 and the circuit board 204 are joined across a border 226. The circuit board 206 and the circuit board 208 are joined across a border 228.

In some embodiments, the circuit boards 202, 204, 206 and 208 are cut using a precision saw or other technique to form the borders 222, 224, 226, and 228 along respective edges of each of the circuit boards 202, 204, 206 and 208. The circuit boards 202, 204, 206 and 208 are joined after completion (e.g., after etching and electronic component attachment) in some embodiments. The borders 222, 224, 226, 228 are cut so that joined edges mirror each other for seamless mating of the circuit boards 202, 204, 206 and 208.

The borders 222, 224, 226 and 228 have a serpentine pattern (e.g., a zigzag pattern, a saw tooth pattern, a serrated pattern, a stepped pattern, a sinusoidal pattern, etc.) in some embodiments. The borders 222, 224, 226 and 228 are configured to preserve patterns of the antenna elements 230 throughout the array on antenna system 200 in some embodiments. For example, the circuit board 202 includes antenna elements 230 arranged in triangular patterns having a unit 232 with two antenna elements 230 in a higher row and one antenna element elements in a lower row and a unit 236 having two antenna elements 230 in the lower row and one antenna element 230 in the higher row in some embodiments. Units 232 and 236 alternate across the array on the circuit boards 202, 204, 206, and 208 in some embodiments. Alternatively, the units 232 and 236 have a diamond pattern of antenna elements 230 (e.g., a unit 235).

In some embodiments, the subarray tiles or the circuit boards 222, 224, 226, and 228 do not need to be identical in any of element count, size and perimeter configuration. The subarray tiles of various forms contiguously fit together like a "jig saw" puzzle in some embodiments. For example, n-omino subarraying can be employed to reduce the effects of parasitic grating lobes. The circuit boards 222 and 224 can be similar to the circuit boards 152(FIG. 1B), 162(FIG. 1C), 154, and 164 in some embodiments.

As shown in FIG. 2, the circuit boards 206 and 208 include units 252, 253, 254, 255, 256, 257, 258, 259, 260 and 261 provided as a consistent triangular pattern across the border 228. The shape of the border 228 avoids breaking the pattern of the units 252, 253, 254, 255, 256, 257, 258, 259, 260 and 261 by allowing an antenna element 270 of the unit 257 to be disposed on the circuit board 208 and allowing the antenna elements 272 and 274 of the unit 256 to be disposed on the circuit board 206. The borders 222, 224, and 226 are configured to preserve similar patterns on the circuit boards 202, 204, 206 and 208. The borders 224, 224, 226, and 228 also serve to prevent the edges of the circuit boards 202, 204, 206, and 208 from affecting the operation of the antenna elements 230 that are close to the edges of the circuit boards 202, 204, 206, and 208 The antenna system 200, like the antenna systems 100A-C (FIGS. 1A-C), can have a variety of shapes and include a different number of circuit boards than the circuit boards 202, 204, 206 and 208 shown in FIG. 2, each with different contours and radiating element counts in some embodiments.

Figure 3:
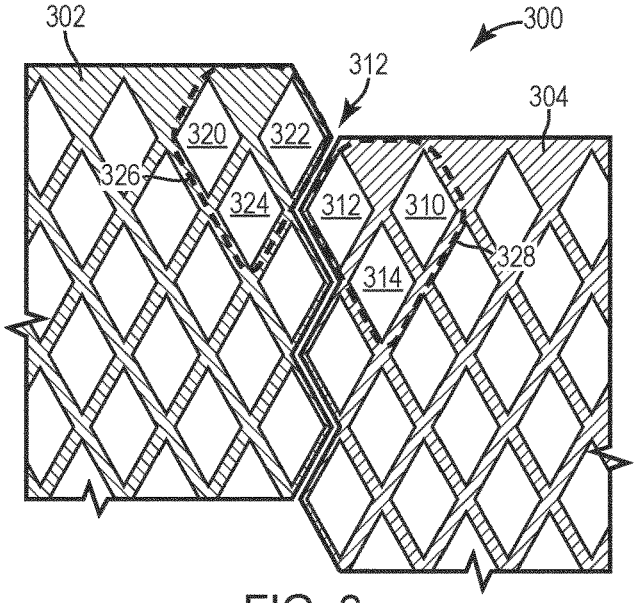
FIG. 3 is a top view more detailed simplified schematic representation of an antenna system including two sub-panels joined at a serpentine border in accordance with some embodiments of the inventive concepts disclosed herein.

With reference to FIG. 3, a portion 300 of an antenna system includes a circuit board 302 and a circuit board 304. The portion 300 may be part of the antenna system 100A-C or the antenna system 200 discussed above with reference to FIGS. 1 and 2 in some embodiments. The circuit board 302 includes an antenna element 320, an antenna element 322, and an antenna element 324 in a unit 326. The circuit board 304 includes an antenna element 310, an antenna element 312, and an antenna element 314 provided in a unit 328. The antenna elements 310, 312, 314, 320, 322, and 324 can each have a triangular or diamond shape in some embodiments.

A border 312 separates the circuit boards 302 and 304. The border 312 has a serpentine pattern (e.g., a saw tooth pattern, zigzag pattern, sinusoidal pattern or serrated pattern). The border 312 preserves the triangular pattern associated with the units 326 and 328.

In some embodiments, the circuit boards 302 and 304 are processed to provide mating across boundary 312. The circuit boards 302 and 304 can be held or fit within the mechanical receptacle to provide a continuous ground across boundary 312. Mechanical indexing alignment pins (e.g., within a mounting frame for the circuit boards 302 and 304) can provide high inter-circuit board directional registration in the X and Y direction. In some embodiments, the circuit boards 302 and 304 can be laid in a radial ring such as in a pie slice arrangement. In some embodiments, there are no metallic traces required across border 312 for all layers of the circuit boards 302 and 304.

Figure 4:
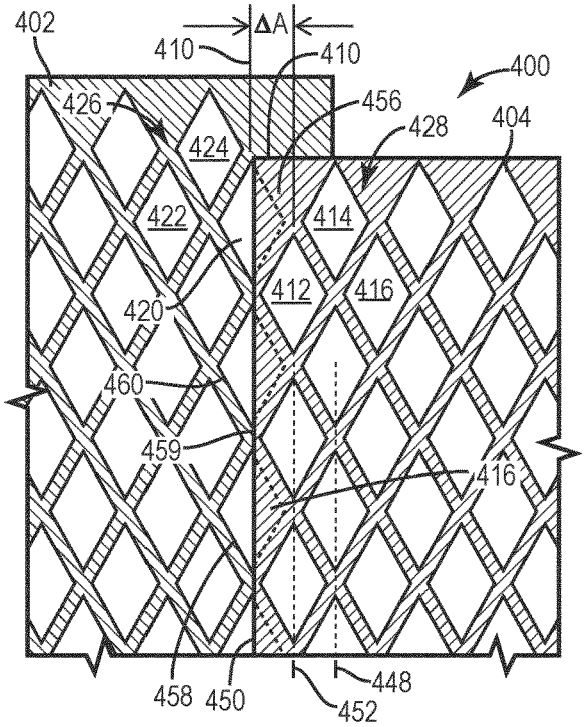
FIG. 4 is a top view more detailed simplified schematic representation of an antenna system including two sub-panels joined at an overlapping border in accordance with some embodiments of the inventive concepts disclosed herein.

With reference to FIG. 4, a portion 400 of an antenna system includes a circuit board 402 and a circuit board 404. The portion 400 may be part of one or more of the antenna systems 100A-C or the antenna system 200 discussed above with reference to FIGS. 1 and 2. The circuit board 402 includes an antenna element 420, an antenna element 422, and an antenna element 424 in a unit 426. The circuit board 404 includes an antenna element 416, an antenna element 412, an antenna element 414, and an antenna element 416 provided in a unit 428.

The circuit boards 402 and 404 are attached to each other using an overlapping border 410. Overlapping border 410 is straight border and does not require the zigzag nature of border 312 discussed above with reference to FIGS. 2 and 3. Overlapping border 410 has a width ΔA which is a distance from an edge 448 of the circuit board 402 to an edge 450 of the circuit board 404. In some embodiments, the edge 448 of the circuit board 402 is at location 452 providing a smaller width ΔA and less overlap of the circuit boards 402 and 404. The size of ΔA is large enough for interface stability and small enough to overlap one half of the antenna element 420, 458, and 460 in some embodiments. Other dimensions can be chosen based upon design criteria and system parameters, such as board strength, antenna element size, the number of over lapped antenna elements, etc. In some embodiments, the portion between location 452 and edge 448 on the circuit board 402 does not include any antenna elements.

The antenna element 420 on the circuit board 402 is disposed at least partially underneath a portion 456 of the circuit board 404 associated with the overlapping border 410. The antenna elements 458 and 460 are similarly disposed partially below the circuit board 404. An antenna element 412 on the circuit board 404 is disposed above a portion 459 of the circuit board 402.

The portions of the circuit board 404 that overlap the antenna elements 420, 458 and 460 at border 410 (e.g., portion 456) are transparent with respect to radio frequency signals such that antenna elements 422 and 458 can transmit and receive signals through the circuit board 404 in some embodiments. Removing ground planes and other signal conductors from the portions of the circuit board 404 that overlap the antenna elements 422 and 457 provides radio frequency transparency in some embodiments. In some embodiments, the entire circuit board material of the circuit board 404 is removed at the location of antenna elements 422, 458 and 460 for transparency.

Figure 5:
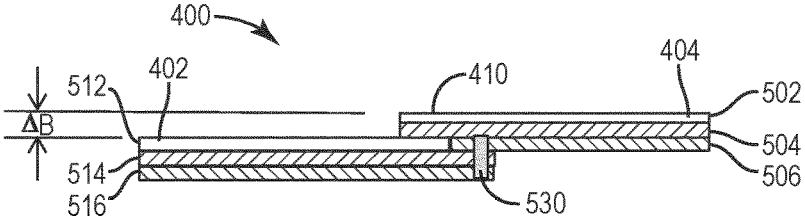
FIG. 5 is a side schematic simplified representation of the antenna system illustrated in FIG. 4.

With reference to FIG. 5, the circuit board 402 is provided underneath the circuit board 404 and attached at the overlapping border 410. The circuit board 404 includes a top layer 512, a middle layer 514 and the bottom layer 516. The circuit board 402 includes a top layer 502, a middle layer 504 and the bottom layer 506. A common radio frequency ground can be provided to the circuit boards 402 and 404 via PCB connections or a pin 530 connecting bottom layer 516 to bottom layer 506. The layers 502 and 504 are transparent or see-through in the radio frequency domain such that the antenna elements 420, 458, and 460 (FIG. 4) on the circuit board 402 can transmit and receive signals. The layer 506 does not overlap the antenna elements 420, 458, and 460 in some embodiments. In some embodiments, layer 514 is coplanar with layer 506.

In some embodiments, the difference in the Z dimension (ΔB) between circuit boards 402 and 404 is relatively small relative to the wavelength for the antenna aperture. The use of the overlapping border 410 provides minimal perturbation to antenna elements 414 and 412 and 420 at the overlapping border 410. Minimal dielectric substrate detuning over radiating elements 420, 458 and 460 can be compensated for by signal processing in some embodiments. The circuit boards 402 and 404 can be arranged in a variety shapes and sizes including pie slices and rectangular pieces.

Figure 6:
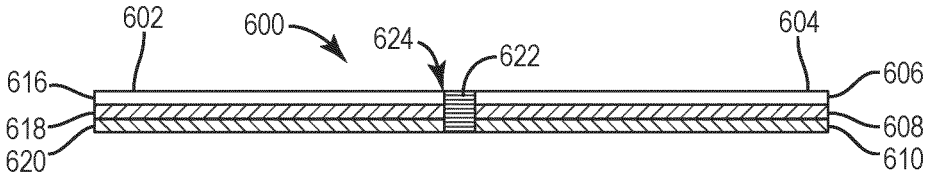
FIG. 6 is a side schematic simplified representation of the antenna system illustrated in FIG. 3.

With reference to FIG. 6, the antenna system 600 can be utilized in one or more of the antenna systems 100A-C and 200 including a circuit board 602 and a circuit board 604. The circuit board 602 and the circuit board 604 are connected by an elastomeric zebra strip 622. The circuit board 602 includes a top layer 616, a middle layer 618 and a bottom layer 620. The circuit board 604 includes a top layer 606, a middle layer 608 and a bottom layer 610. In some embodiments, layers 606 and 616, layers 608 and 618, and layers 610 and 620 are coplanar with each other. In some embodiments, edge tolerances for antenna system are provided in +/−0.002 inches using optical drilling or routing for artwork edge tolerances of +/−0.002 inches. In some embodiments, laser direct imaging allows front to back artwork registration on the order of +/−0.0015 inches. The elastomeric zebra strip 622 can be configured to allow edge compression. A border 624 associated with the elastomeric zebra strip 622 can be a serrated border in some embodiments.

Figure 7:
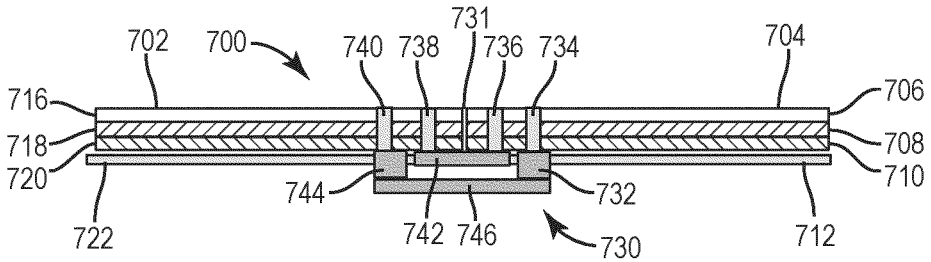
FIG. 7 is a side schematic simplified representation of the antenna system illustrated in FIG. 3.

With reference to FIG. 7, an antenna system 700 can be utilized as one or more of the antenna systems 100A-C or 200 and includes a circuit board 702 and circuit board 704 in some embodiments. The circuit board 702 is comprised of a top layer 706, a middle layer 708 and a bottom layer 710. The circuit board 704 includes a top layer 716, a middle layer 718 and a bottom layer 720. A support layer 722 can be provided underneath the circuit board 704 and attached to the circuit board layer 702. A support layer 712 can be provided underneath circuit board 702 and attached to the bottom layer 710. The support layers 712 and 722 are rigid dielectric, semiconductor, or metal substrates in some embodiments.

A bridge structure 730 joins the circuit boards 702 and 704 across a border 731 which can be a serpentine border in some embodiments. The bridge structure 730 includes a bridging conductor 730, a conductor 732, a conductor 734, a conductor 736, a conductor 738, a conductor 740, a bridging conductor 742, and a conductor 744. The conductor 734 is a ground via or pin that is connected to the conductor 740 which is a ground via or pin. The conductor 734 is coupled to the conductor 740 via the conductors 732 and 734, and the bridging conductor 746. The conductor 736 is a signal via or pin coupled to the conductor 734 which is also a signal via or pin in some embodiments. The conductor 734 is coupled to the conductor 740 via the bridging conductor 742.

The conductor 736, the conductor 738, and the bridging conductor 742 are disposed within the conductor 744, the conductor 740, the conductor 732, the conductor 734, and the bridging conductor 746 in some embodiments. The conductors 740 and 734 in the circuit board 704 are coupled to the support layers 712 and 722 in some embodiments. The attachments between components of the bridging structure 730 and the support layers 712 and 722 and the layers 710 and 720 can be made by soldering in some embodiments.

Figure 8:
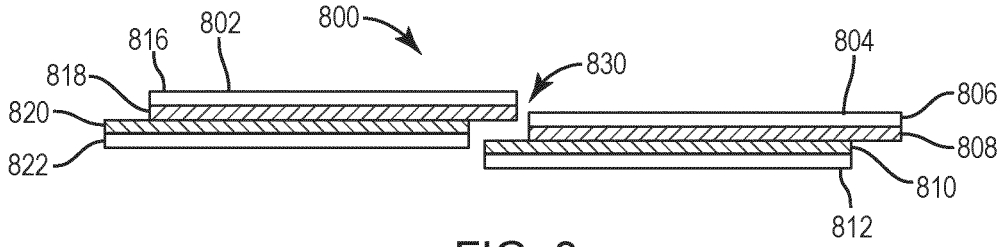
FIG. 8 is a side schematic simplified representation of the antenna system illustrated in FIG. 3.

With reference to FIG. 8, an antenna system 800 includes a circuit board 802 and a circuit board 804. The circuit board 802 includes a top layer 806, a middle layer 808 a middle layer 810, and a bottom layer 812. The circuit board 802 includes a top layer 816, a middle layer 818, a middle layer 820, and a bottom layer 822. The circuit board 802 and the circuit board 804 are coupled by a lap joint 830. Connections between the circuit boards 802 and 804 can be made using solder connections between the layer 818 and the layer 810. The RF interconnection between 802 and 804 can also be non-contacting electric field coupling techniques, as commonly known in the art.

Figure 9:
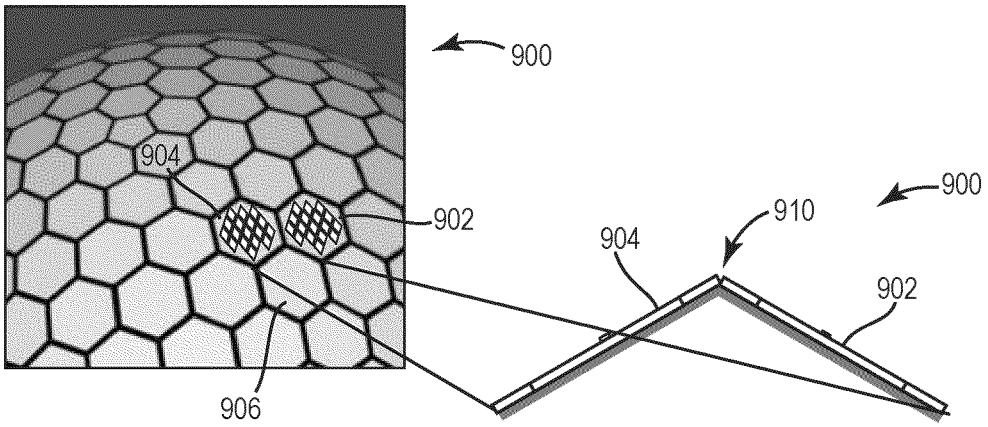
FIG. 9 is a top view more detailed simplified schematic representation of an antenna system including sub-panels joined to form a curved surface in accordance with some embodiments of the inventive concepts disclosed herein.

With reference to FIG. 9, an antenna system 900 can provide a shaped antenna system including spherical, curved, or other shaped surfaces. In some embodiments, the antenna system 900 is a double curved surface. The antenna system 900 includes the circuit boards 902, 904 and 906 which can be similar to the circuit boards 102 and 104 (FIG. 1A) or the circuit boards 202 and 204 (FIG. 2).

The circuit board 904 can be attached to the circuit board 902 via a bent joint 910. The circuit boards 902, 904, and 906 can be arranged as n-agonal planar facets (where N is a number equal to or greater than 3) shown as hexagonal or 6-agonal shape in FIG. 9. A flex circuit board can be utilized to provide a feed manifold for the circuit boards 902, 904 and 906 or a combination of a flex circuitry and a ridged PCB subassembly in some embodiments.

In some embodiments, the bent joint 910 is achieved using a zebra strip. The zebra strip is effective at small bend angles in some embodiments. At more extreme angles, a conducting bridge can be utilized to attach the circuit boards 902 and 904. In some embodiments, a lap joint can be utilized with a flex circuit interposer.

Figure 10:
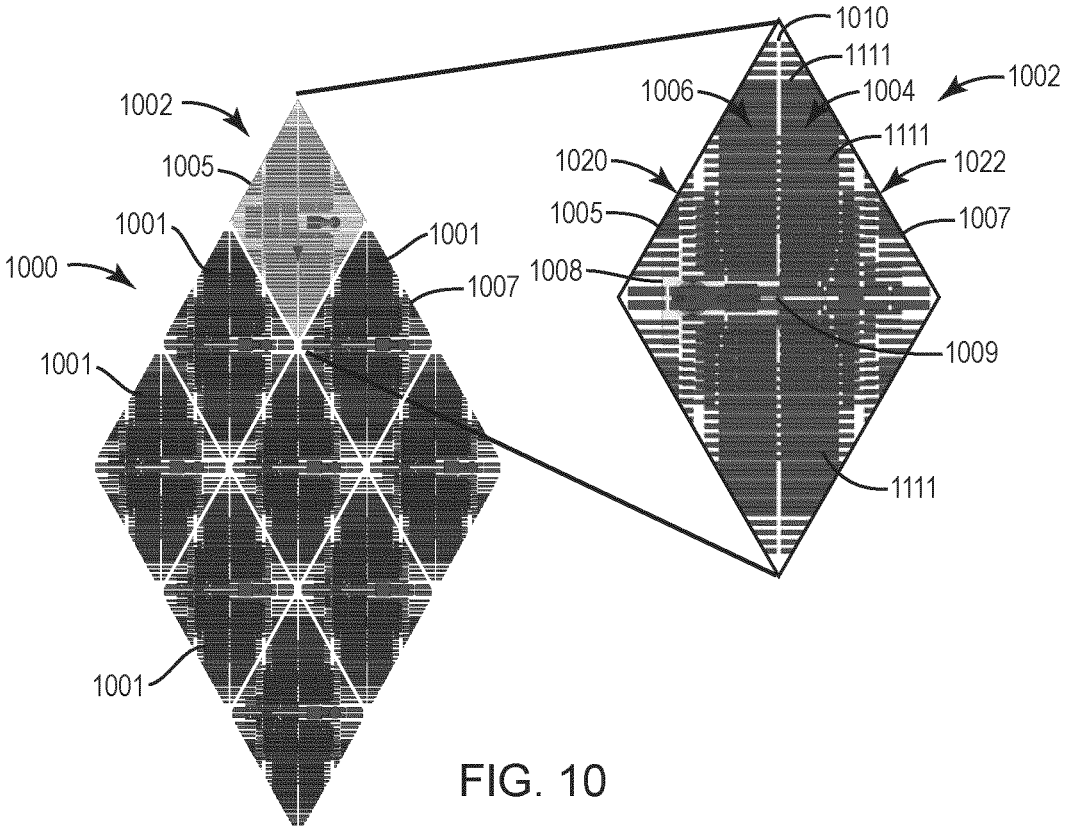
FIG. 10 is a top view more detailed simplified schematic representation of a sub-panel including an antenna element in accordance with some embodiments of the inventive concepts disclosed herein.

With reference to FIG. 10, an array 1000 of antenna elements 1001 includes an antennae element 1002 on circuit boards 1005 and 1007 which can be similar to the circuit boards 102 and 104 (FIG. 1A). Numbers of antenna elements 1001 are provided on the circuit board 1005, and a number of the antenna elements 1001 are provided on the circuit board 1007. The antenna element 1002 is diamond shaped and provided in close spatial relationship with other diamond-shaped antenna elements in some embodiments. The antenna element 1002 can advantageously be split such that a portions of the antenna element 1002 are disposed on different sub-panels or circuit boards (e.g., the antenna element 1002 is partially on the circuit board 1005 and partially on the circuit board 1007). Other antenna elements 1001 are provided with the portion of the antenna element 1002 on the circuit board 1005, and other antenna elements 1001 are provided with the portion of the antenna element 1002 on the circuit board 1007 in some embodiments.

The antenna element 1002 includes conductors 1004 and 1006 disposed horizontally. Critical circuit components 1008 are provided for antenna element 1002 at a location offset from a center point 1009 of the antenna element and outside of a vertical gap 1010 that separates the conductors 1004 and 1006. In addition, each of conductors 1006 and 1004 is separated from each other by horizontal gaps 1111. Antenna element 1002 can be cut or separated along the vertical gap 1010 or the horizontal gaps 1111 while avoiding cutting the conductors 1004 and 1006 and the critical circuit components 1008 in some embodiments.

In some embodiments, a left half 1020 of the antenna element 1002 is on the circuit board 1005 (or sub panel) and a right half 1022 of the antenna element 1002 is on the circuit board 1007 (or sub panel). Conductors 1006 and 1004 are capacitively or radio frequency coupled to each other without direct electrical contact in some embodiments.

In some embodiments, each layer associated with the antenna element 1002 each includes the vertical gap 1010 and the horizontal gaps 1111. In some embodiments, the vertical gap 1010 is 722.4 mils wide and the horizontal gaps 1111 are 1251.1 mils wide. In addition, the circuit boards 1005 and 1007 associated with the antennae element 1002 can have a higher dielectric constant (e.g. 3.63) to increase capacitance between each layer associated with the antenna element 1002. The spacing from copper to copper in the antenna element 1002 is 10.5 mills in some embodiments.

Figure 11:
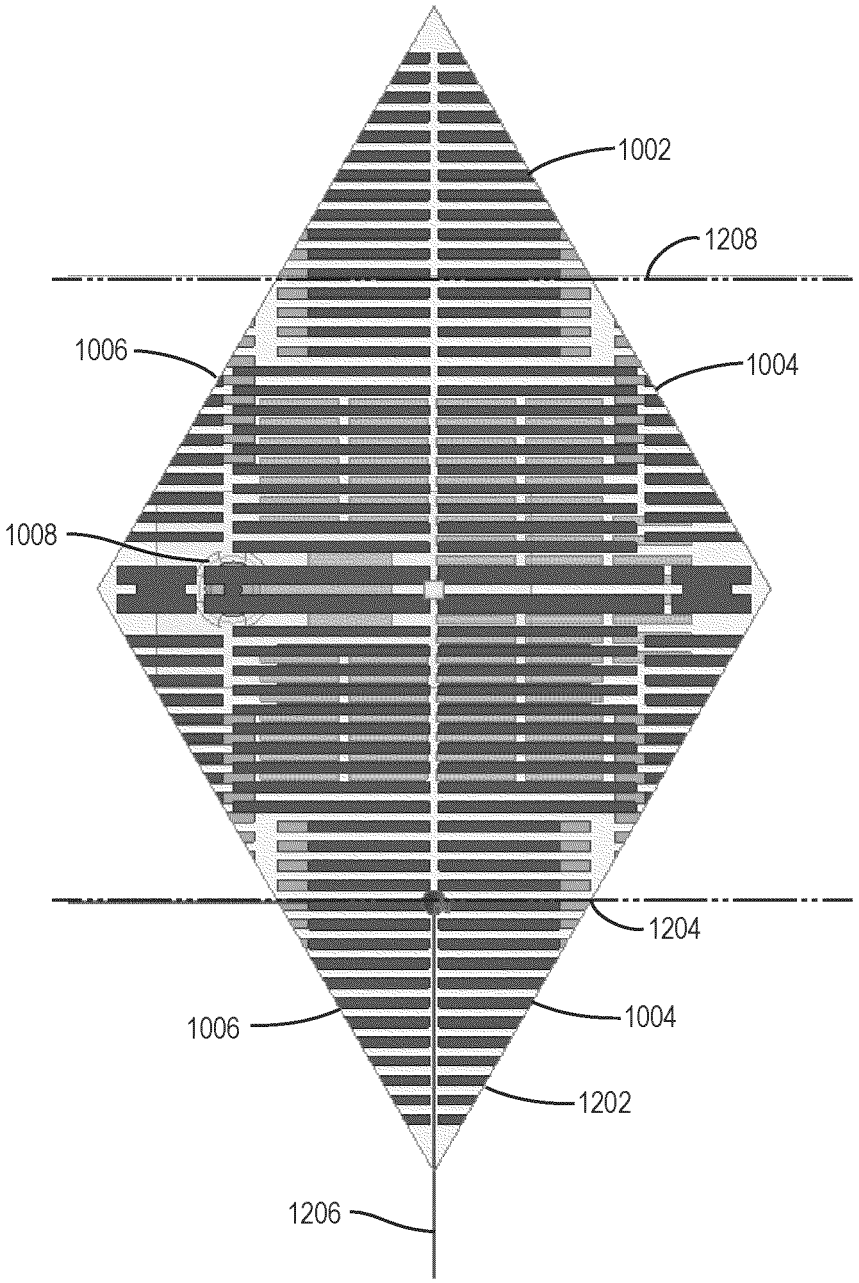
FIG. 11 is a top view more detailed simplified schematic representation of the antenna element illustrated in FIG. 10.

With reference to FIG. 11, antenna element 1002 can be divided, cut or rejoined across a border 1204, a border 1206 and/or a border 1208. The border 1206 is provided between conductors 1004 and 1006 along the gap 1010 associated with the various layers 1030, 1032, and 1034 (FIG. 11). The borders 1204 and 1208 are provided between conductors 1004 and 1006 along the horizontal gaps 1111 associated with the various layers 1030, 1032, and 1034 (FIG. 11). The borders 1204, 1206, and 1208 do not interfere with critical circuit components 1008 in some embodiments. Accordingly, antenna array 100 or 200 can be manufactured using the antenna elements 1001 that are split at the border between the sub-panels (e.g., the circuit boards 1005 and 1007). The borders can extend in different directions (e.g. perpendicular from each other) such that the sub panels can be tiled in any fashion.

Figure 12:
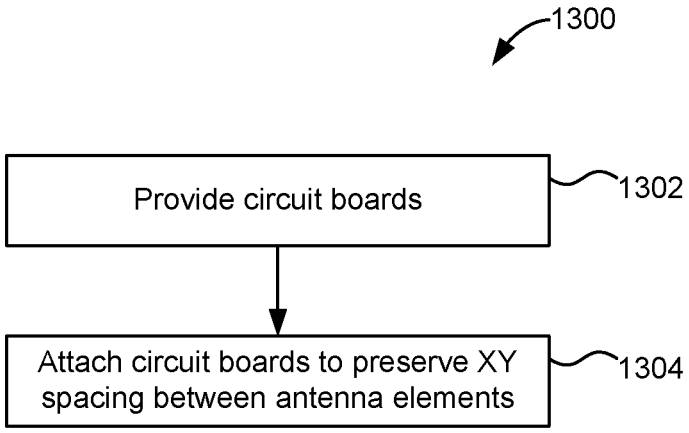
FIG. 12 is a flow diagram showing a flow for joining circuit boards to provide an antenna system.

With reference to FIG. 12, a flow 1300 is used to manufacture antenna system 100A-C or 200 (FIGS. 1 and 2). At an operation 1302, circuit boards (e.g., 102 and 104 or 202 and 204) are created including antenna elements (e.g., antenna elements 122, 230, 1001, 1002, etc.). Circuit components are attached in the operation 1302 in some embodiments. The edges of the circuit boards have a serpentine edge or an edge configured for an overlapping interface in some embodiments. In some embodiments, the edges are not configured with a serpentine edge or overlapping interface and a first circuit board has a partial antenna element (e.g., the left half 1020 of the antenna element 1002) (FIG. 10) at an edge that matches a partial antenna element (e.g., the right half 1022 of the antenna element 1002) at an edge of a second circuit board.

At an operation 1304, the circuit boards are joined. The circuit boards are joined using the borders discussed with reference to FIG. 3-9 in some embodiments. In some embodiments, the circuit boards can be joined using a support medium. The circuit boards can be fit together attached to the support medium in some embodiment. For example, the circuit boards 1005 and 1007 can be attached using a rigid board beneath boards 1005 and 1007 and attaching the circuit boards 1005 and 1007 to the support medium so that the antenna element 1002 is a complete element. At the operation 1304, the circuit boards are attached to preserve XY displaced between the antenna elements and to preserve a triangular or diamond pattern in some embodiments.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements and circuit boards, values of parameters, mounting arrangements, use of materials, colors, orientations, etc.). For example, the position of elements and sub-panels may be reversed or otherwise varied and the nature or number of discrete elements or positions may be altered or varied. Accordingly, all such modifications are intended to be included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the scope of the inventive concepts disclosed herein.

What is claimed is:

1. An antenna, comprising:

a first antenna tile comprising a first tile first layer, a first tile second layer, and a first tile third layer, the first tile first layer comprising a plurality of first antenna elements;

a second antenna tile comprising a second tile first layer, a second tile second layer, and a second tile third layer, the second tile first layer comprising a plurality of second antenna elements; and wherein the first antenna tile is joined to the second antenna tile at an edge, wherein the edge is configured so that a first portion of the first tile second layer is directly above a second portion the second tile third layer, wherein at least one signal connection between the first antenna tile and the second antenna tile is made using the first portion and the second portion.

2. The antenna of claim 1, wherein the edge is a serpentine edge having at least one of a saw tooth and sine wave shape, wherein the first antenna tile and the second antenna tile each have a different shape, antenna element count, or contour.

3. The antenna of claim 1, wherein the first antenna elements and the second antenna elements provide a repeating pattern of antenna element units, each of the antenna element units comprising at least three antenna elements, wherein the first antenna tile and the second antenna tile are joined to each other at the edge configured so that the antenna elements in each antenna element unit are not divided at the edge, wherein the repeating pattern is one of a triangular pattern and a diamond pattern, wherein one antenna element in a first set of the antenna element units is disposed in a first row and two antenna elements in the first set of the antenna element units are disposed in a second row, wherein one antenna element in a second set of the antenna element units is disposed in the second row and two antenna elements in the second set of the antenna element units are disposed in the first row, wherein the repeating pattern is one of a triangular pattern and a diamond pattern, wherein one antenna element in a first set of the antenna element units is disposed in a first row and two antenna elements in the first set of the antenna element units are disposed in a second row, wherein one antenna element in a second set of the antenna element units is disposed in the second row and two antenna elements in the second set of the antenna element units are disposed in the first row.

4. The antenna of claim 1, wherein the first tile first layer and the second tile first layer provide a co-planar top surface of the antenna.

5. The antenna of claim 1, wherein the first antenna tile and the second antenna tile are attached to a mechanical receptacle providing a connection between the plurality of antenna tiles.

6. The antenna of claim 1, wherein the plurality of antenna tiles are attached via an elastomeric zebra strip providing a connection between the first antenna tile and the second antenna tile.

7. The antenna of claim 1, wherein the first antenna tile and the second antenna tile are each attached to a mounting panel and wherein a signal bridge is disposed within a ground bridge, wherein the signal bridge and the ground bridge are coupled to respective conductors of the first antenna tile and the second antenna tile and the mounting panel.

* * * * *